US006089289A

United States Patent [19]

Florjancic

[11] Patent Number: 6,089,289

[45] **Date of Patent: *Jul. 18, 2000**

[54] PLASTIC HOLDER FOR TWO CREDIT CARDS

[75] Inventor: Peter Florjancic, Bled, Slovenia

[73] Assignee: Theodor Schöttli, Diessenhofen, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/849,671

[22] PCT Filed: Dec. 15, 1995

[86] PCT No.: PCT/SI95/00027

§ 371 Date: Jul. 31, 1997

§ 102(e) Date: Jul. 31, 1997

[87] PCT Pub. No.: WO96/18320

PCT Pub. Date: Jun. 20, 1996

[30] Foreign Application Priority Data

| | | | |
|---|---|---|---|
| Dec. 16, 1994 | [SI] | Slovenia | 9400442 |
| May 18, 1995 | [SI] | Slovenia | 9500170 |
| Jun. 26, 1995 | [SI] | Slovenia | 9500207 |

[51] Int. Cl.[7] ..... A45C 11/18

[52] U.S. Cl. ..... 150/147; 206/39.5; 206/39.6

[58] Field of Search ..... 150/147; 206/39.5, 206/39, 39.1, 39.2, 39.3, 39.4, 39.6, 39.7, 39.8, 387.14, 387.15

[56] References Cited

U.S. PATENT DOCUMENTS

| | | | |
|---|---|---|---|
| 4,301,917 | 11/1981 | Ancell | 206/39.5 |
| 4,577,914 | 3/1986 | Stravitz | 206/387.15 X |
| 4,629,066 | 12/1986 | Howard | 206/387.15 |
| 4,674,628 | 6/1987 | Prinsloo et al. | 206/39 X |
| 4,915,215 | 4/1990 | Brekke | 150/147 X |
| 5,020,255 | 6/1991 | Rodel | 206/39.5 X |

FOREIGN PATENT DOCUMENTS

| | | |
|---|---|---|
| 0 337 452 A2 | 10/1989 | European Pat. Off. . |
| 2 705 210 A1 | 11/1994 | France . |
| 3607779 A1 | 10/1986 | Germany . |
| 87 16 345 U1 | 3/1988 | Germany . |
| 89 00 078 U1 | 3/1990 | Germany . |
| 90 00 892 U1 | 6/1990 | Germany . |
| 92 16 844 U1 | 3/1993 | Germany . |

*Primary Examiner*—Stephen P. Garbe
*Assistant Examiner*—Tri M. Mai
*Attorney, Agent, or Firm*—Akin, Gump, Strauss, Hauer & Feld, L.L.P.

[57] ABSTRACT

The plastic holder for two credit cards in accordance with the invention has eliminated the drawbacks of known card holders with such a design solution that makes possible the production of a jacket (1) in which there is space for two credit cards (A, B) and that is easy to produce by spraying, because of an intermediate rib (2) which runs along the middle of the inner side of the lateral walls and the end wall, and which thus represents a guide for individual card (A, B) in the holder and does not damage its surface and/or magnetic tape (C), and in addition, provides support during the spraying procedure, so that no other holding elements need to be added. Inside the holder, additional protrusions (5) or (6, 6') are carried out, which slightly bend individual card. At the inner sides of the upper plane (1') and the lower plane (1") of the jacket (1) additional protrusions (3, 3') are carried out, so that the planes (1, 1") of the plastic jacket (1) have a slightly concave shape.

11 Claims, 9 Drawing Sheets

PLASTIC HOLDER FOR TWO CREDIT CARDS

The invention concerns a plastic holder for two credit cards, preferably cards of standard format used instead of cash payment (e.g. banker's cards, credit cards, phone cards, and the like). The holder under the invention is made of injection molded plastic and designed so that it allows simple and trouble-free insertion and extraction of individual cards, without danger of damage to the surface of the cards or the recording on the magnetic strip. The invention belongs to the IPC class B 65 D 65/00.

The technical problem which is successfully solved by the claimed invention is how to design and carry out a holder that will be easy to injection mold and whose form will allow easy and trouble-free insertion and extraction of two cards, whereby the two cards will be protected against accidental falling out, and may be of non-standard thickness.

Credit cards are known to be inserted into special holders in order to protect their sensitive surface and the embossed data or data recorded on a magnetic strip. These holders make it impossible to damage the surface of the card or the magnetic tape. The main drawback of the known holders is in that their form and structure allow the insertion of only a single credit or other card. When one possesses several cards, these—when put into holders—will make up a greater thickness and will be inconvenient for carrying in a wallet or in the pocket. Besides, the structure of known single-card holders does not allow simple injection molding without supporting elements, which produce holes in the finished holder.

The plastic holder for two credit cards in accordance with the invention eliminates the drawbacks of known implementations by means of a design solution which makes it possible to produce a holder in which there is space for two credit cards, and which is easy to manufacture by injection molding, because of an intermediate rib which runs along the middle of the lateral walls and the end wall, thus representing a guide for each individual card in the holder without damaging its surface and/or the magnetic strip, and in addition, providing support during the injection molding procedure, so that no holding elements need to be added. The improved plastic holder for two credit cards in accordance with the invention improves the basic design solution in that the elasticity of the cards themselves is utilized to prevent accidental fall-out of the cards. Inside the holder, special protrusions are added which slightly bend the card and thus prevent it from falling out.

The invention will be described by way of example and with reference to the accompanying drawings in which.

Figure 1:
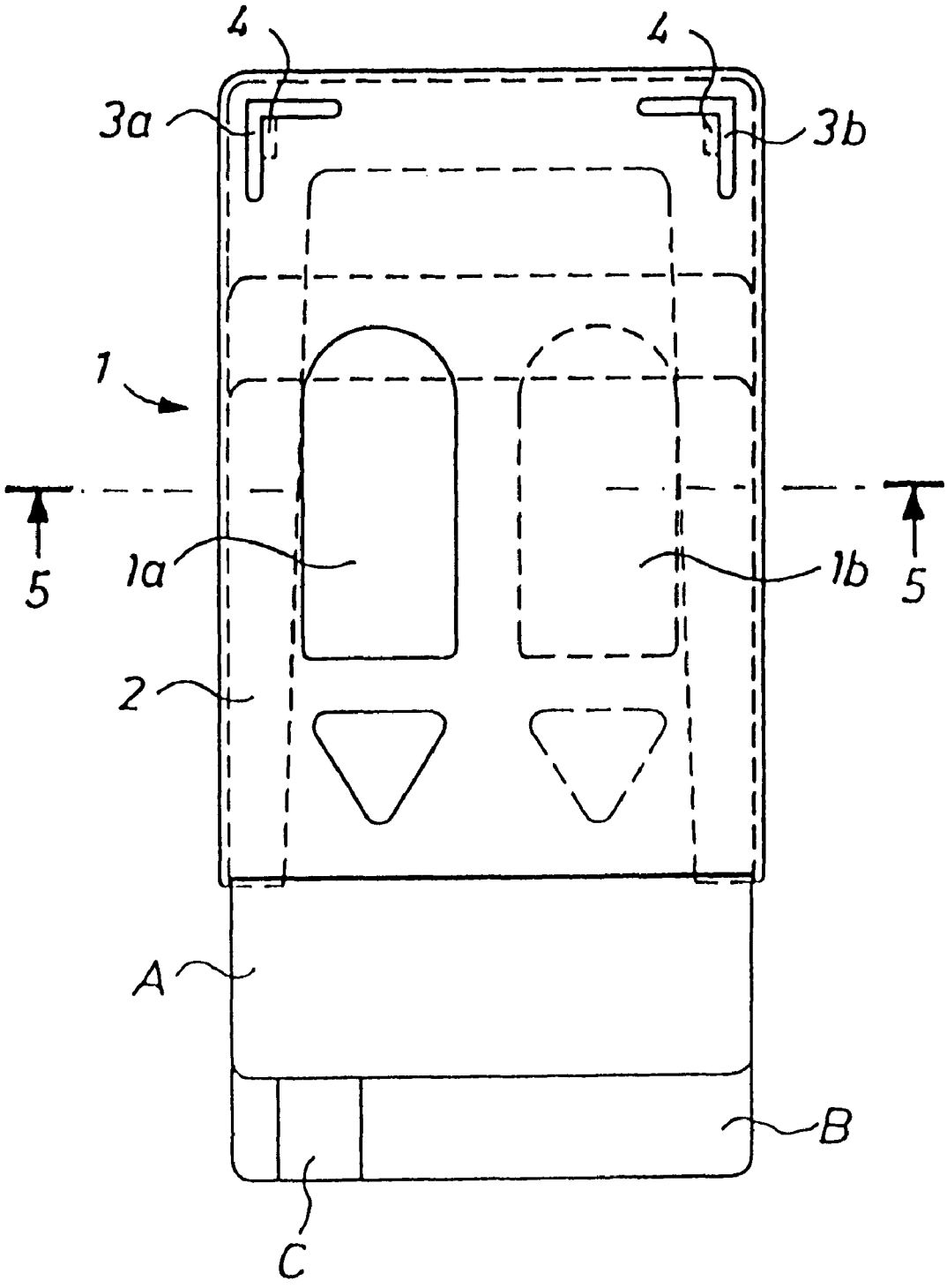
FIG. 1 is a top view of a plastic holder for two credit cards in accordance with the invention with partly inserted cards.

FIG. 1 illustrates a plastic holder for two credit cards in accordance with the invention with partly inserted cards in a top view. The holder is, basically, an injection molded, at one end open, plastic jacket 1 into which cards A and B are inserted. The jacket 1 is fitted, at the inside, with an intermediate rib 2 which runs along the middle of the inner side of the lateral walls and the end wall of the jacket 1. Said rib 2 serves as a guide for individual card A, B in the holder, and does not damage its surface and/or a magnetic strip C on the cards A, B, and in addition, provides support during the production (i.e. injection molding) of the jacket 1, so that there is no need to add any auxiliary supporting elements when producing the jacket 1.

The substantially solid front and the rear faces of the jacket 1 are carried out with larger, basically rectangular, cut-outs 1*a* and 1*b* with one of their shorter sides having the shape of a semi-circle. The cut-outs 1*a* and 1*b* allow the pushing of individual card A or B into, and facilitate the extraction of the cards A and B out of the jacket 1.

Figure 2:
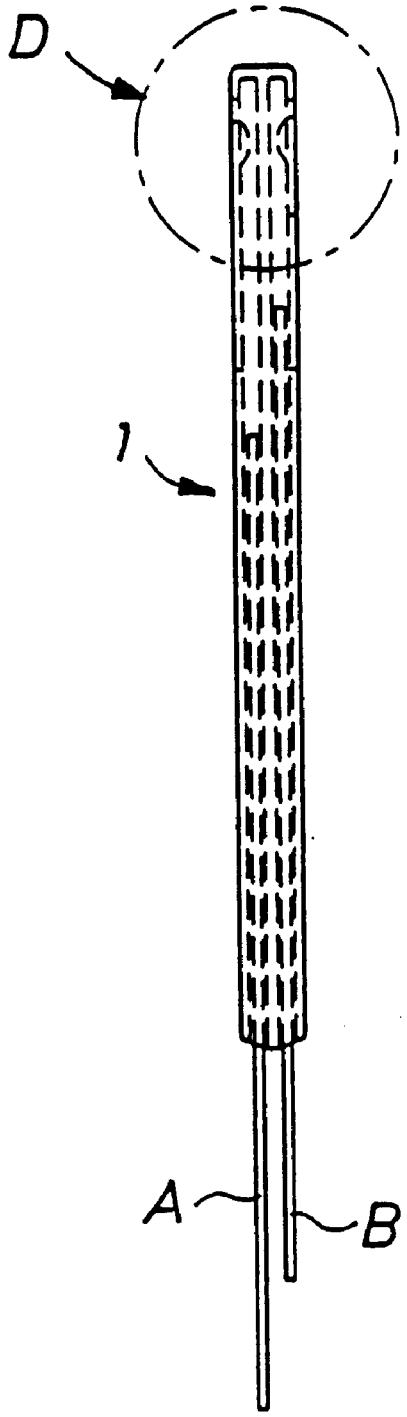
FIG. 2 is a side view of a plastic holder for two cards in accordance with the invention.
Figure 3:
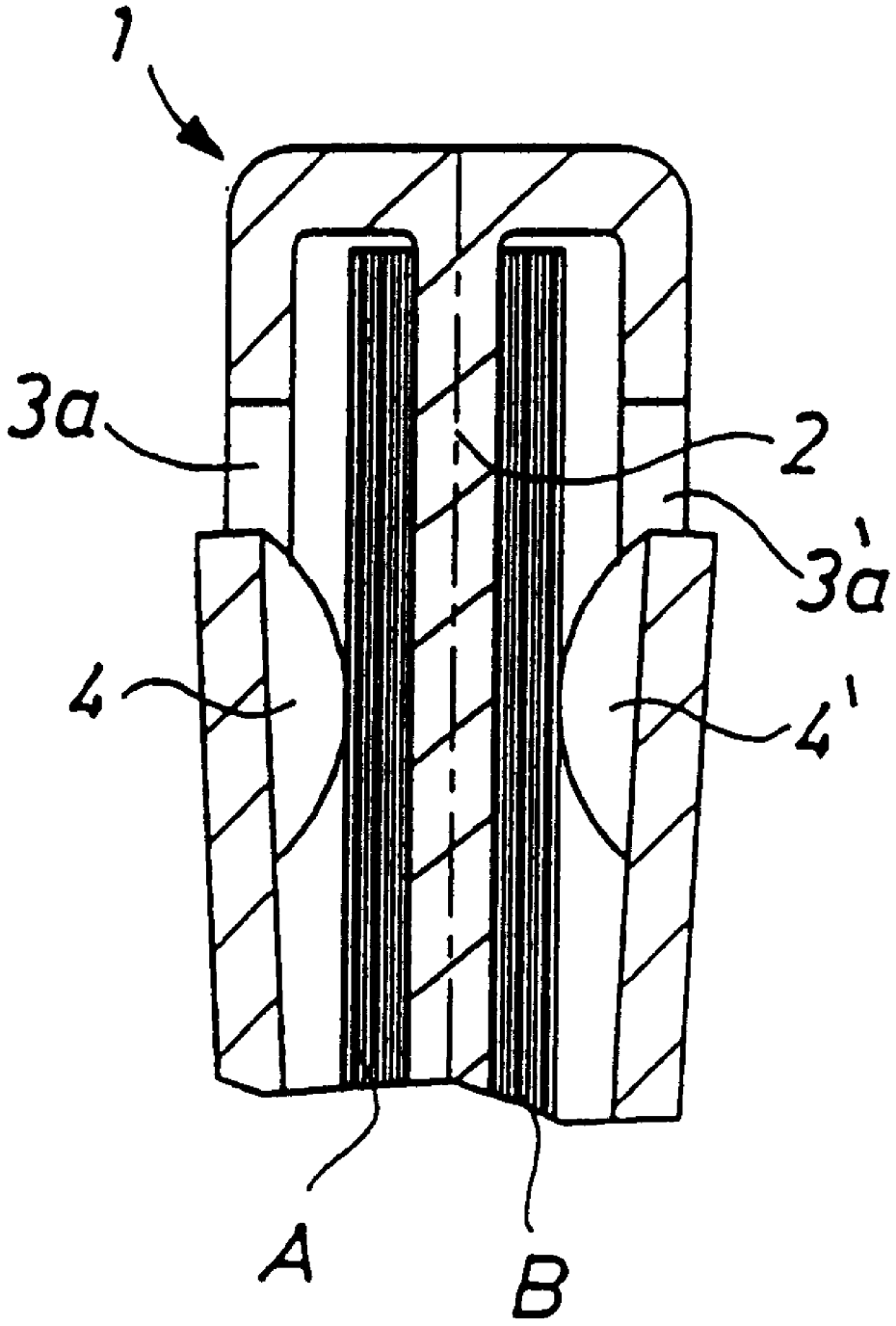
FIG. 3 is an enlarged view of the detail of FIG. 2 illustrating a pair of followers holding the cards.
Figure 4:
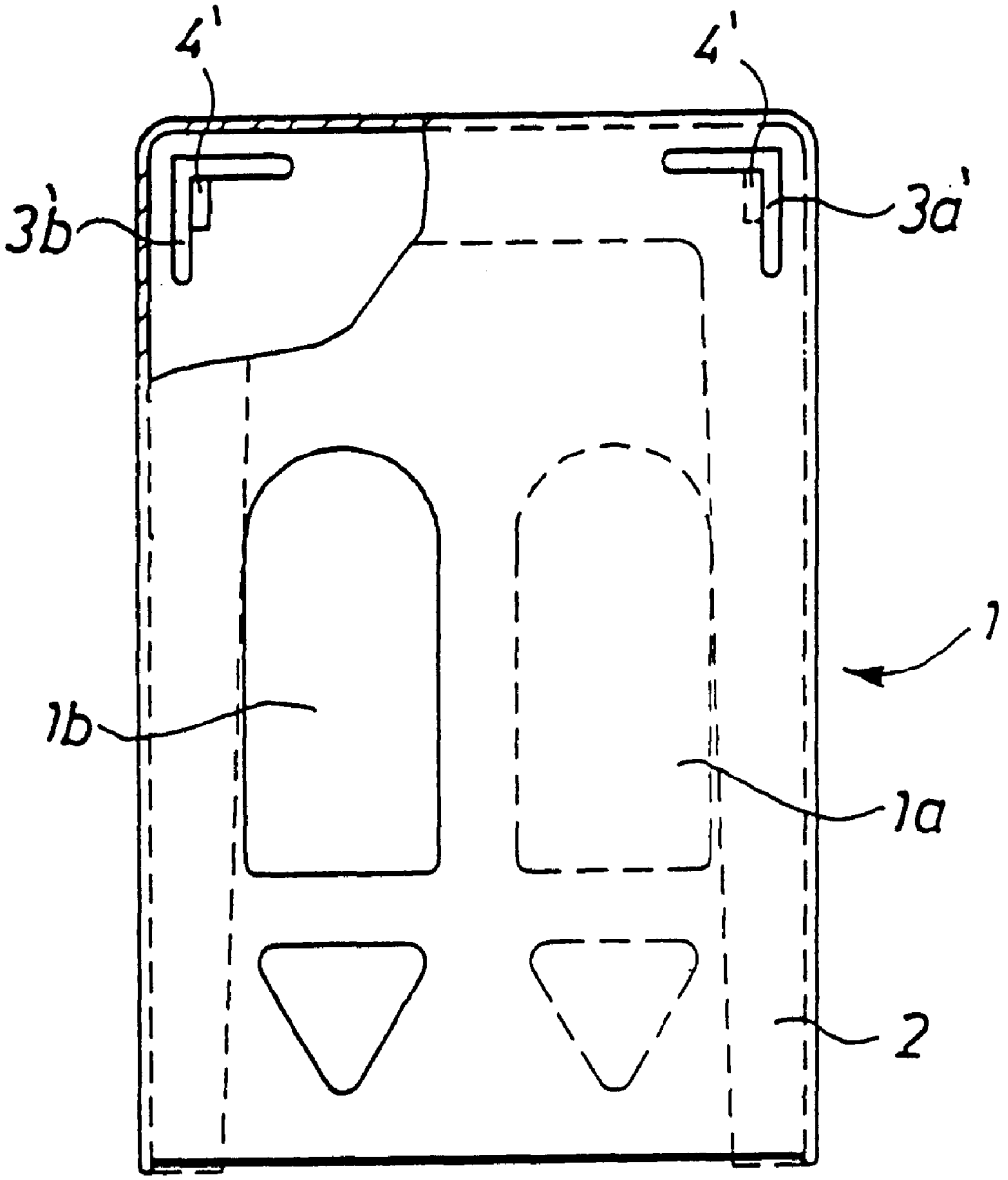
FIG. 4 is a bottom view of a plastic holder for two credit cards in accordance with the invention, without inserted cards, in a partial cross-section.
Figure 5:
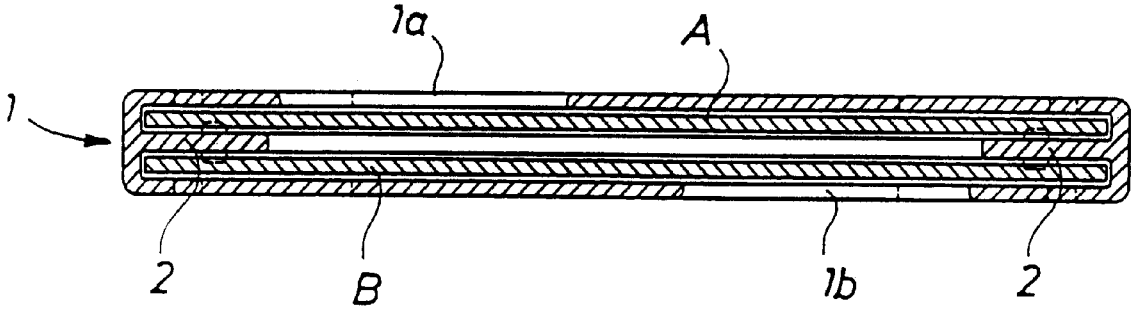
FIG. 5 is a cross-section of a plastic holder for two credit cards in accordance with the invention taken along line 5—5 of FIG. 1.

In the comers of the shorter side of the jacket 1, opposite the opening for insertion of the cards A and B, smaller openings 3*a*, 3*b* and 3*a*', 3*b*' are made in the shape of a rectangular cut-out, and on the inside of the front and the rear faces of the jacket 1, i.e. on the part embraced by the openings 3*a*, 3*b* and 3*a*', 3*b*', followers 4 and 4' are placed, the positioning and shape of which are illustrated in FIG. 2 and as details in FIG. 3.

The plastic holder for two credit cards in accordance with the invention thus successfully solves the given technical problem, and in addition, its structure allows simple injection molding without additional holding and supporting elements, so that the holder in accordance with the invention is without unnecessary holes.

Figure 12:
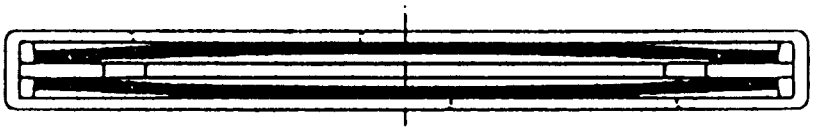
FIG. 12 is a front elevational view of embodiment I of the plastic holder for two credit cards in accordance with the invention, with inserted cards.
Figure 13:
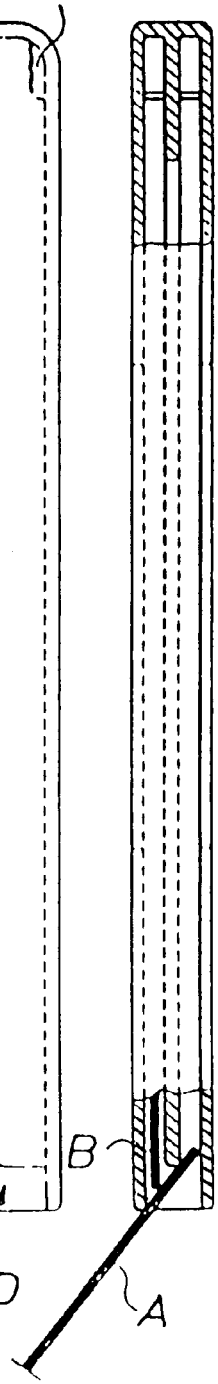
FIG. 13 is a side elevational view in partial cross-section of embodiment I of the plastic holder for two credit cards in accordance with the invention, with inserted cards.

Embodiment I of a plastic holder for two credit cards in accordance with the invention is illustrated in a top view, a side view in partial cross-section, and in a front view with inserted cards in FIGS. 12 and 13.

Figure 6:
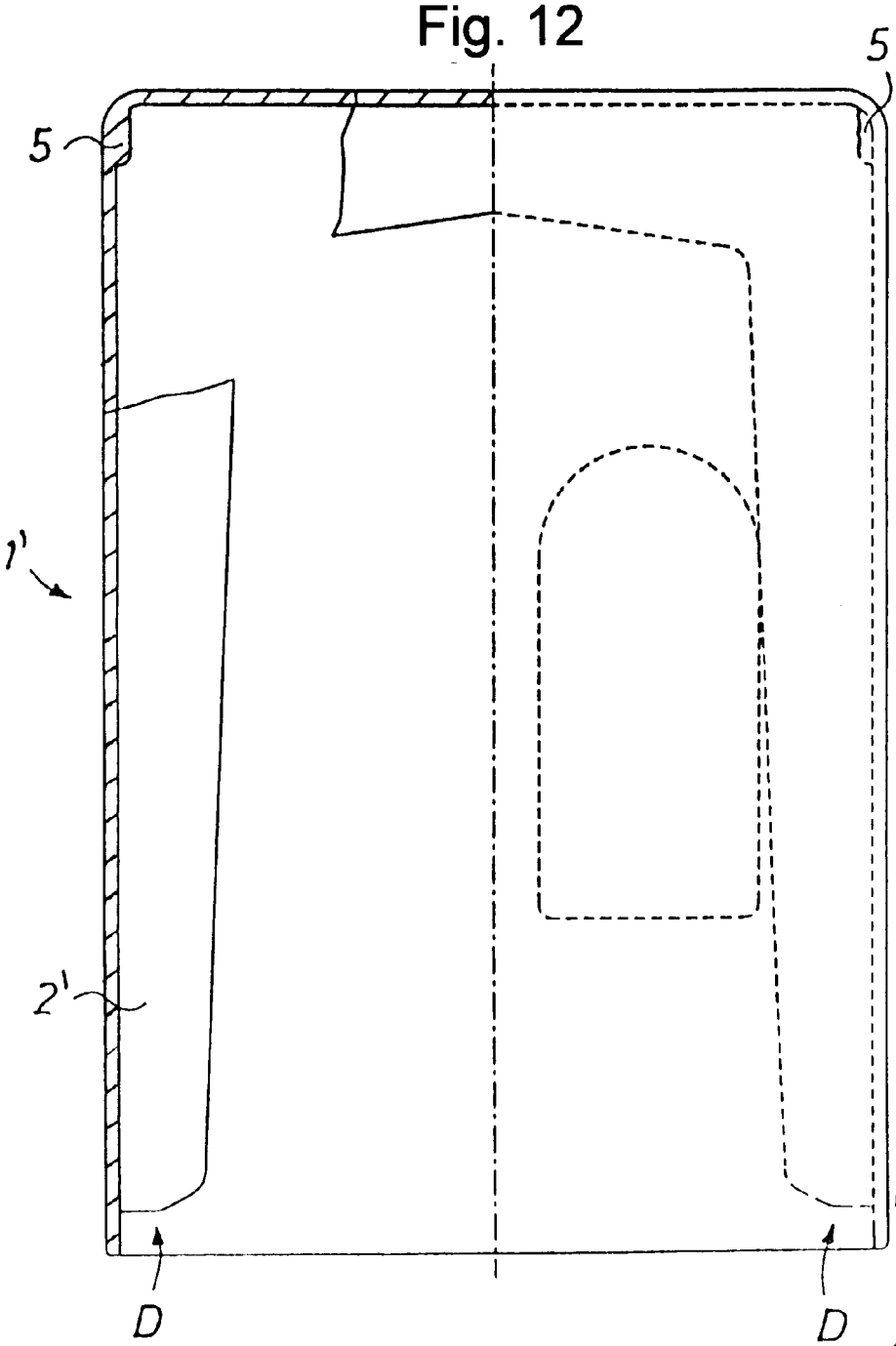
FIG. 6 is a top plan view, of embodiment I of a plastic holder for two credit cards in accordance with the invention, with inserted cards.

A jacket 1' is fitted at the inside with an intermediate rib 2' which runs along the middle of the inner side of the lateral walls and the end wall of the jacket 1'. The rib 2' serves as a guide for each individual card in the holder, and does not damage its surface and/or magnetic strip. At the front end of the rib proximate to the open end of the jacket ends, the rib 2' has a slightly semi-circular form, and it is shorter than the total length of the jacket 1', while its width is slightly increasing towards the shorter side of the jacket, and at the part which is parallel to the shorter side of the jacket 1', it is also slightly conical. The conical shape of the rib 2' and its semi-circular ends, allow the cards to freely slide into the jacket 1', while the shorter length of the rib 2' in comparison with the total length of the jacket 1', facilitates the handling, i.e. inserting and extracting, of the cards A and B, which is also illustrated in FIGS. 6, 12 and 13.

In the comers of the shorter side of the jacket 1', opposite the opening for the insertion of cards A and B, above and beneath the level of the rib 2', small protrusions 5 are made. The protrusions 5 make the space for individual card A and B smaller, so that when inserted, they slightly bend, which can also be seen in the front view of the embodiment I of improved plastic holder for two credit cards in accordance with the invention in FIG. 6. Such position of the cards A and B in the improved holder, prevents the cards from falling out accidentally.

Figure 14:
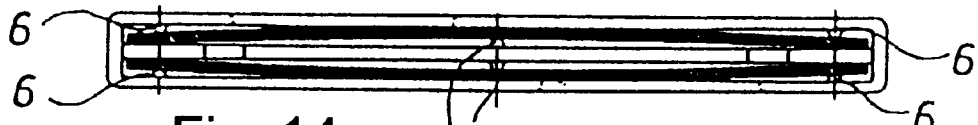
FIG. 14 is a front elevational view of embodiment II of the plastic holder for two credit cards in accordance with the invention, with inserted cards.
Figure 7:
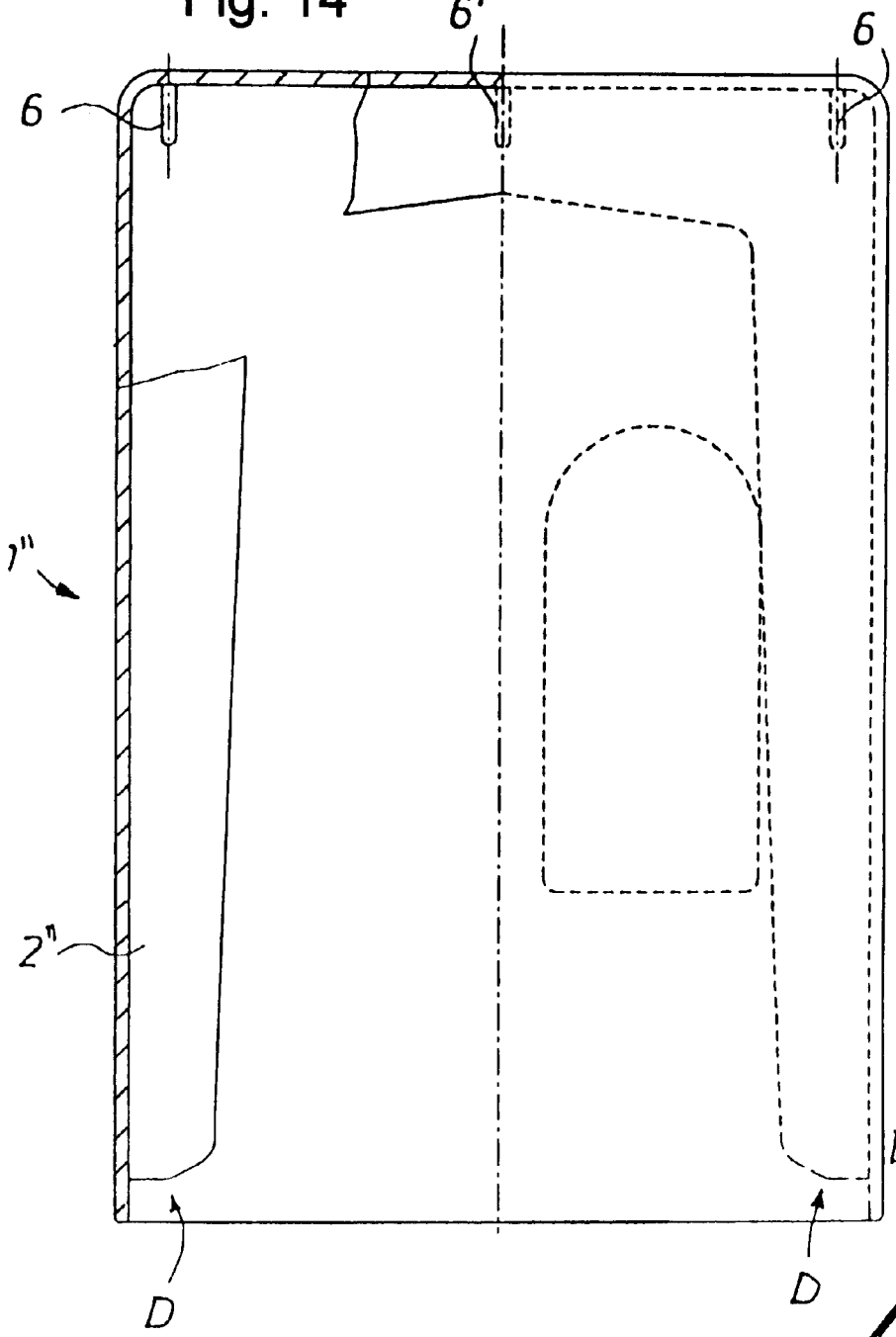
FIG. 7 is a top plan view, of embodiment II of a plastic holder for two credit cards in accordance with the invention, with inserted cards.
Figure 15:
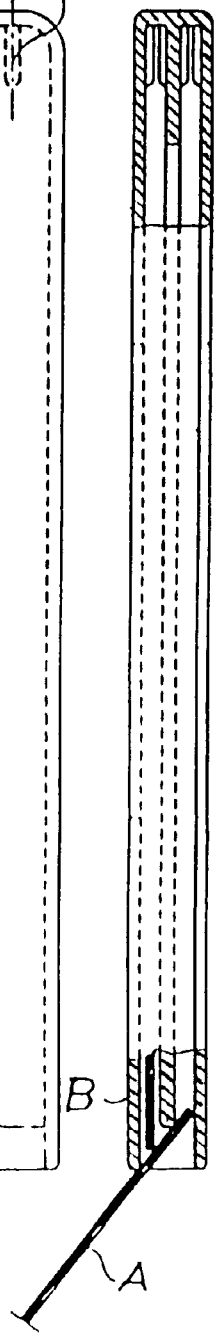
FIG. 15 is a side elevational view of embodiment II of the plastic holder for two credit cards in accordance with the invention, with inserted cards.

Embodiment II of an improved plastic holder for two credit cards in accordance with the invention is illustrated in a top view, a side view in partial cross-section, and in a front view with inserted cards in FIG. 7, 14 and 15.

A jacket 1" is fitted on the inside with an intermediate rib 2" which runs along the middle of the inner side of the lateral walls and the end wall of the jacket 1". The rib 2" serves as a guide for individual card in the holder, and does not damage its surface and/or magnetic tape. At the front end of the rib 2" has a slightly semi-circular form, and it is shorter than the total length of the jacket 1", while its width is slightly increasing towards the shorter side of the holder, and at the part which is parallel to the shorter side of the jacket 1", it is also slightly conical. The conical shape of the rib 2" and its semi-circular ends, allow the cards to freely slide into the jacket 1", while the shorter length of the rib 2" in comparison with the total length of the jacket 1", facilitates the handling, i.e. inserting and extracting, of the cards A and B, which is also illustrated in FIG. 7, 14 and 25.

In the comers of the shorter side of the jacket 1", opposite the opening for insertion of cards A and B, smaller, oblong and semi-circular protrusions 6 and 6' are made. The two protrusions 6 stick out at the inner side of both external surfaces of the improved plastic holder in accordance with the invention, while the protrusion 6' sticks out in the middle of the rib 2". A similar distribution of the protrusions 6 and 6' is repeated on the other side of the holder.

When cards A and B are pushed into the improved holder, and as individual card is pushed into embrace of the protrusions 6 and 6', it slightly bends, which can also be seen in the front view of the embodiment II of improved plastic holder for two credit cards in accordance with the invention, in FIG. 7, 14 and 15. Such position in the holder prevents the cards A and B from accidentally falling out.

Figure 8:
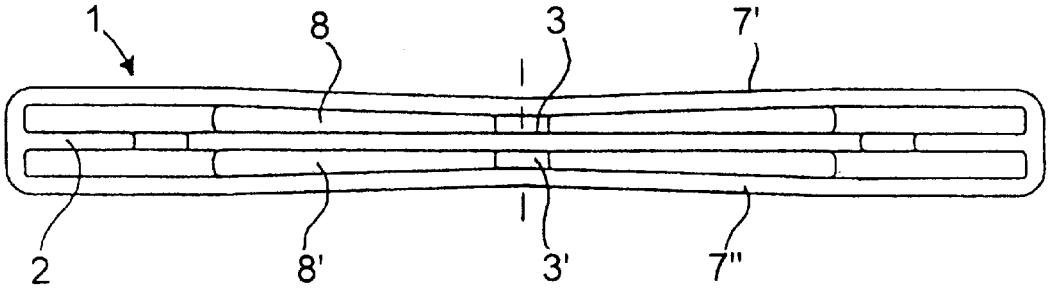
FIG. 8 is a front elevation view of a plastic holder for two cards of different thickness in accordance with the invention.

A plastic holder for two credit cards of different thickness in accordance with the invention is shown in a front view from the side of insertion of cards in FIG. 8.

A jacket 1 is fitted on the inside with a rib 2, which runs along the middle of the inner side of the lateral walls and the end wall of the jacket 1. Said rib 2 serves as a guide for individual card in the holder and does not damage its surface and/or magnetic strip. In the end wall at the shorter end of the jacket 1 (opposite the opening for insertion of cards), two lengthy grooves or cut outs, 8, 8' are made with their length being at least ¾ of the width of individual card.

In the middle of the jacket's 7 width, in the inner side of the front face of the jacket 1 and the rear face 7" of the jacket 1, protrusions 3, 3' in the shape of followers are made which are cut off slantwise toward the side where the cards are inserted. The slantwise cut of the protrusions 3, 3' facilitates the insertion of the cards and prevents them from getting stuck when fully inserted.

Since the protrusions 3, 3' are linked with the front and rear faces through injection molding, both 7', 7" the front and rear sides are slightly concavely bent, so that the protrusions 3, 3' lean against the rib 2.

Figure 9:
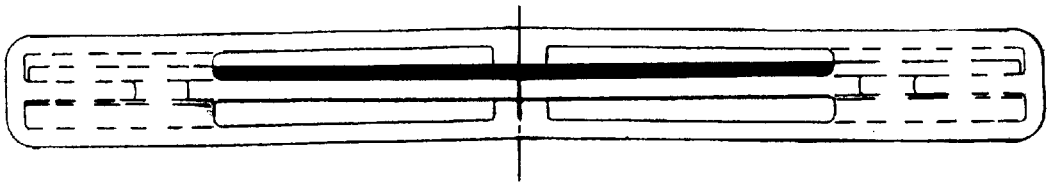
FIG. 9 is a rear view (opposite the opening for inserting the cards) of a plastic holder for two credit cards of different thickness in accordance with the invention, with one inserted card.

At insertion of a card, as shown in FIG. 9, the card is pushed between the protrusion 3 and the rib 2 in such a way that the card pushes with its thickness the front face of the jacket 1 upwards. In this way the front, side acts as a spring which holds the card in embrace and stops it from falling out.

The rear face 7" of the jacket 1 and the protrusion act in the same way when the second card is inserted.

Figure 10:
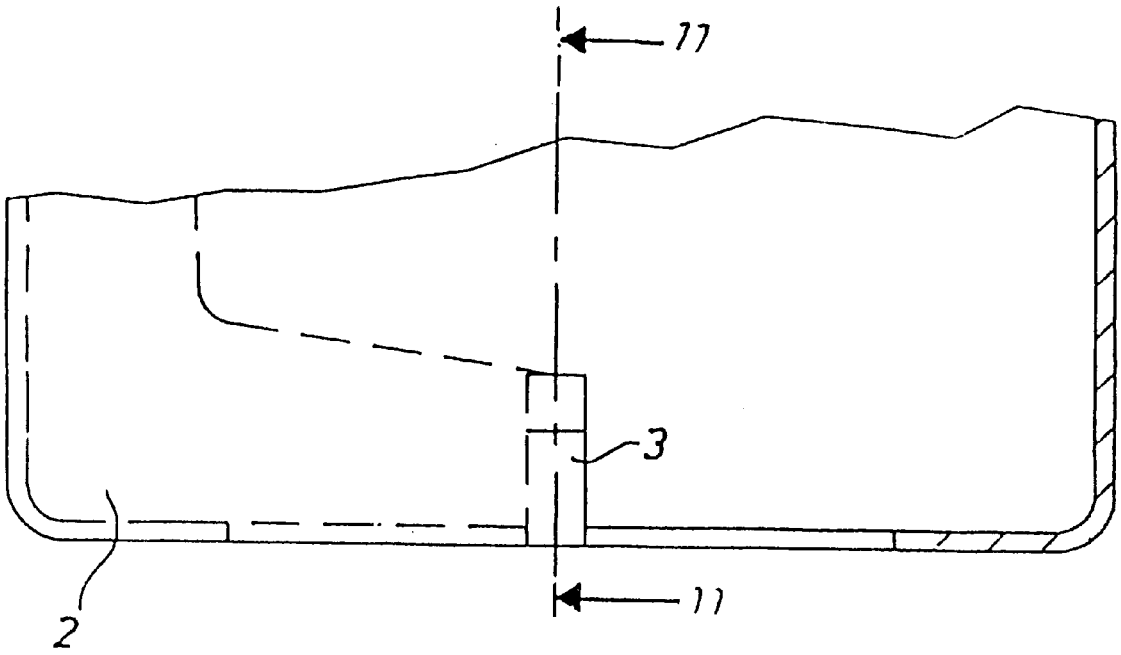
FIG. 10 is a top view of the shorter side of the plastic holder for two credit cards of different thickness in accordance with the invention.
Figure 11:
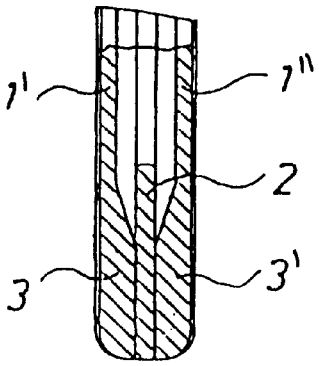
FIG. 11 is the 11—11 cross-section of the plastic holder for two credit cards taken along the lines 11—11 of FIG. 10.

The protrusions 3, 3' as seen from the side are shown in FIG. 11, which illustrates the 11—11 A cross-section from FIG. 10.

What is claimed is:

1. A plastic holder for two credit cards, the holder comprising a jacket into which cards are inserted, the jacket comprising substantially rectangular front and rear faces connected on three sides by first and second lateral walls and an end wall with an open end on a fourth side, and an intermediate rib, the intermediate rib having a major plane lying substantially parallel to and between the front and rear faces and extending inwardly from the lateral walls and the end wall, the front and rear faces being substantially continuous except for at least one cutout in each face for slidingly accessing the respective card adjacent thereto, the end wall having at least two cutouts, one between the rib and the front face and another between the rib and the rear face, the end wall cutouts extending laterally less than a total width of a credit card to be inserted in the plastic holder.

2. The plastic holder for two credit cards as claimed in claim 1, wherein said jacket is made of injection molded plastic.

3. The plastic holder for two credit cards as claimed in claim 1, wherein a width and a thickness of the rib provide support during injection molding of the jacket.

4. The plastic holder for two credit cards as claimed in claim 1, wherein the cut-outs in the front and rear faces of the jacket are substantially rectangular with one of the shorter sides of the cut-outs having a semi-circular form.

5. The plastic holder for two credit cards as claimed in claim 1, wherein the front and rear faces are slightly concave when no card is inserted and act as a spring to prevent an inserted card from falling out.

6. The plastic holder for two credit cards as claimed in claim 1, wherein the front and rear faces each have a protrusion on an inner surface, each protrusion having a slope of a follower and a slant toward the open end.

7. The plastic holder for two credit cards as claimed in claim 6, wherein the front and rear faces are slightly concave, and the concavity biases each protrusion toward the rib when the respective card is not inserted.

8. The plastic holder for two credit cards as claimed in claim 1, wherein the cutouts extend at least ¾ of the width of the credit card to be inserted.

9. The plastic holder for two credit cards as claimed in claim 1, wherein a width of the rib in its major plane along the first and second lateral walls increases toward the end wall and then decreases toward the center of the end wall, and the rib terminates with a semicircular shape in its major plane before reaching the end of the first and second lateral walls adjacent the open end.

10. The plastic holder for two credit cards as claimed in claim 9, wherein opposite the opening end for insertion of cards, oblong semi-circular protrusions stick out, with two of the protrusions sticking out in the corners of the end wall of the jacket on the inner side of the front and rear faces respectively, and two protrusions being positioned in the middle and on either side of the rib.

11. The plastic holder for two credit cards as claimed in claim 9, further comprising small protrusions at the corners where the first and second lateral walls meet the end wall, said protrusions lying above and beneath the major plane of the rib for engaging each respective card.

* * * * *